US007739813B2

(12) United States Patent
Beaton

(10) Patent No.: US 7,739,813 B2
(45) Date of Patent: Jun. 22, 2010

(54) TELESCOPING BOOM FOR EXCAVATING APPARATUS

(76) Inventor: Eric Beaton, 6145 Walker Rd., Utica, NY (US) 13502

( * ) Notice: Subject to any disclaimer, the term of this patent is extended or adjusted under 35 U.S.C. 154(b) by 629 days.

(21) Appl. No.: 11/405,157

(22) Filed: Apr. 17, 2006

(65) Prior Publication Data

US 2007/0243051 A1 Oct. 18, 2007

(51) Int. Cl.
*E02F 3/32* (2006.01)

(52) U.S. Cl. ..... 37/443; 37/347; 37/379; 414/718

(58) Field of Classification Search ..... 37/395, 37/397, 443; 414/680, 682, 685, 718, 728; 52/117, 118
See application file for complete search history.

(56) References Cited

U.S. PATENT DOCUMENTS 3,072,272 A * 1/1963 Howlett ..... 414/718
4,054,185 A * 10/1977 Stedman ..... 187/226
4,162,873 A * 7/1979 Smith, Jr. ..... 414/718
4,245,441 A * 1/1981 Smith, Jr. ..... 52/111
4,395,192 A * 7/1983 Schlafly ..... 414/718
5,092,733 A * 3/1992 Kishi ..... 414/718
5,507,107 A * 4/1996 Pinomaki ..... 37/403

* cited by examiner

*Primary Examiner*—Thomas A Beach
*Assistant Examiner*—Matthew R Buck
(74) *Attorney, Agent, or Firm*—David Giglio, Esq.

(57) ABSTRACT

There is provided a telescoping boom system for an excavating apparatus which includes a linkage member having a pivot segment and lever segment pivoted about a rotating fixed boom. A first hydraulic cylinder is coupled from the fixed boom to the pivot segment. A second hydraulic cylinder is coupled from the lever segment to a retractable outer boom. The first hydraulic cylinder extends to rotate the pivot segment away from a proximate end of the fixed boom, thus forcing the lever segment to rotate towards the proximate end of the fixed boom. The second hydraulic cylinder retracts and combines with the extension force of the first hydraulic cylinder across the linkage member to provide a retraction force to the outer boom.

14 Claims, 12 Drawing Sheets

TELESCOPING BOOM FOR EXCAVATING APPARATUS

FIELD OF THE INVENTION

The present invention relates generally to the field of excavation apparatuses and, more particularly, to a telescoping boom for an excavation apparatus.

BACKGROUND OF THE PRESENT INVENTION

In the construction industry, it is often necessary to grade a surface for various reasons, such as paving, installing walkways, landscaping etc. It is also necessary to dig holes for foundations, basements, swimming pools and the like. Excavation which includes digging and grading is accomplished via an operating implement, such as a grading bucket, digging bucket, grapple, hammer, screening bucket etc., which is disposed at the outer end of a telescoping boom or a jointed boom.

Excavation using a jointed boom is accomplished via a backhoe. The jointed boom works well for digging because the jointed boom operates at a quick speed. However, the jointed boom is rather difficult to control for grading purposes. Thus, a separate bulldozer must be brought on site for grading.

An excavation apparatus 100 having a telescoping boom is known in the industry as a Gradall® which is depicted in FIG. 1 as a prior art reference. Gradall's® are manufactured and sold by Gradall®, New Philadelphia, Ohio.

A Gradall® typically contains a vehicle base 118 or frame which rolls on wheels or, for more difficult terrain, tracks 112. An operator sits in a cab 120 which is mounted to the vehicle base 118. The cab 120 typically rotates or swings horizontally on the vehicle base 118. A boom support member 132 is disposed off to one side of the cab 120.

The cab 120 rotates on a fulcrum disposed on the vehicle base, which allows the operator to rotate the telescoping boom to define the excavation stroke.

The telescoping boom includes a rotating fixed boom which is fixedly secured to a rotating plate within the boom support member. A worm gear, known in the art, turns the rotating plate thus rotating the fixed boom about its longitudinal axis, thus allowing the operator to define the grading angle.

The boom support member is fixedly secured to a pivot plate which pivots rotationally about the side of the cab. A pivot plate hydraulic cylinder controls such pivoting, thus adjusting the angle of the telescoping boom relative the plane of the earth, which either defines the angle of excavation or allows the telescoping boom to be removed from the excavation surface for rotation or movement.

An outer boom 146 extends and retracts within the fixed boom 144. The grading bucket is disposed at the end of the outer boom 146. An axially aligned hydraulic cylinder 111 controls the extension and retraction of the outer boom 146. Thus, the operator sets the cab 120 for the direction of the grading stroke, sets the pivot plate for the proper grading angle, extends the outer boom 146 the appropriate length, adjusts the worm gear to define the grading angle and then works the grading bucket and then retracts the outer boom 146 to finish the grade or dig.

The main problem with this telescoping boom is that it works too slow to be efficient for various tasks. The axially aligned hydraulic cylinder 111 that controls the extension and retraction of the outer boom contains a very long piston that must be moved the same length as the movement of the outer boom. Thus, the operation of the outer boom is slow.

Further, and more importantly, a large amount of hydraulic fluid must be moved to force the movement of the within cylinder. Moving such large amount of hydraulic fluid repeatedly during strokes builds up heat. The built up heat wears out the hydraulic cylinder and causes the hydraulic fluid lines to develop cracks.

OBJECTS AND SUMMARY OF THE PRESENT INVENTION

It is an object of the present invention to improve the construction industry and, more particularly to improve the art of excavation.

It is another object of the present invention to improve the rate at which grading surfaces is conducted.

It is a further object of the present invention to improve an excavating apparatus having a telescoping boom.

It is still another object of the present invention to provide a telescoping boom that extends and retracts faster than the telescoping boom of the prior art.

It is yet a further object of the present invention to provide a hydraulic controlled telescoping boom in which the outer boom extends and retracts a greater length than the piston of the hydraulic cylinder that controls such movement.

It is still a further object of the present invention to provide a single excavation apparatus that is suitable for both fine grading and digging.

These objects are provided for in the present invention in which a grading apparatus includes a vehicle base having at least one wheel means, which includes wheels and/or tracks, integrated therewith. An operator seating position is provided by a cab. The cab swings horizontally on the base.

A boom support member is fixed to the pivot plate. A telescoping boom, connected to the boom support member, includes both a fixed boom and an outer boom. The fixed and inner booms are axially aligned so that the outer boom retracts and extends within the fixed boom.

A pivot plate is disposed off to one side of the cab and is hydraulically controlled to allow the pivot plate to be rotated for angular adjustment. The adjustment of the pivot plate results in an angular adjustment of the telescoping boom relative to the planar surface of the earth.

The fixed boom is connected at its base to a rotating plate disposed within the boom support member. A worm gear rotationally displaces the fixed boom about its longitudinal axis, which allows for an adjustment to the grading or digging angle of a grading bucket relative to the planar surface of the earth.

A first hydraulic cylinder, or first displacement member, is pivoted at a first end to either the fixed boom or the boom support member. The hydraulic cylinder includes a housing and a piston that retracts and extends within the housing.

A linkage member is pivoted to the fixed boom at a first connection. The linkage member includes a pivot segment which is connected to the piston of the first hydraulic cylinder.

The linkage member further includes a lever segment extending from the pivot. A distal end of the lever segment is coupled to the outer boom. Thus, as the pivot segment is rotated about the pivot by the first hydraulic cylinder the lever segment rotates with the pivot segment and thus moves the outer boom.

A second hydraulic cylinder can be used to connect the lever segment with the outer boom. For additional length, the piston of the second hydraulic cylinder is couple to a linkage to improve the length of the coupling between the lever segment and the outer boom.

Thus, for increased speed the second hydraulic cylinder also extends and retracts the outer boom.

BRIEF DESCRIPTION OF THE DRAWINGS

The present invention will be understood and appreciated more fully from the following detailed description taken in conjunction with the drawings in which.

DETAILED DESCRIPTION OF THE PRESENT INVENTION

Figure 1:
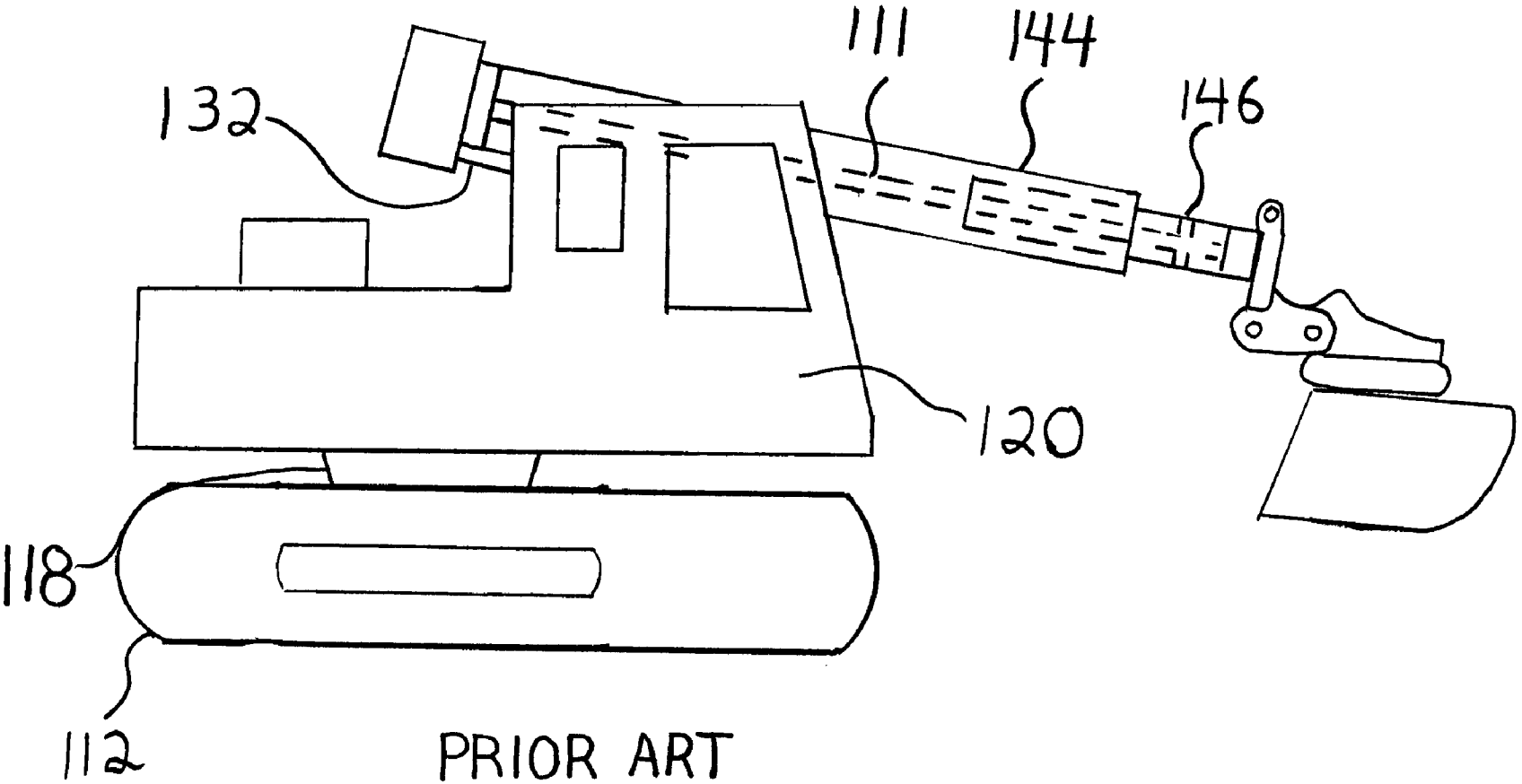
PRIOR ART FIG. 1
FIG. 1 is an elevation view of an excavating apparatus having a telescoping boom system in accordance with the prior art.
Figure 2:
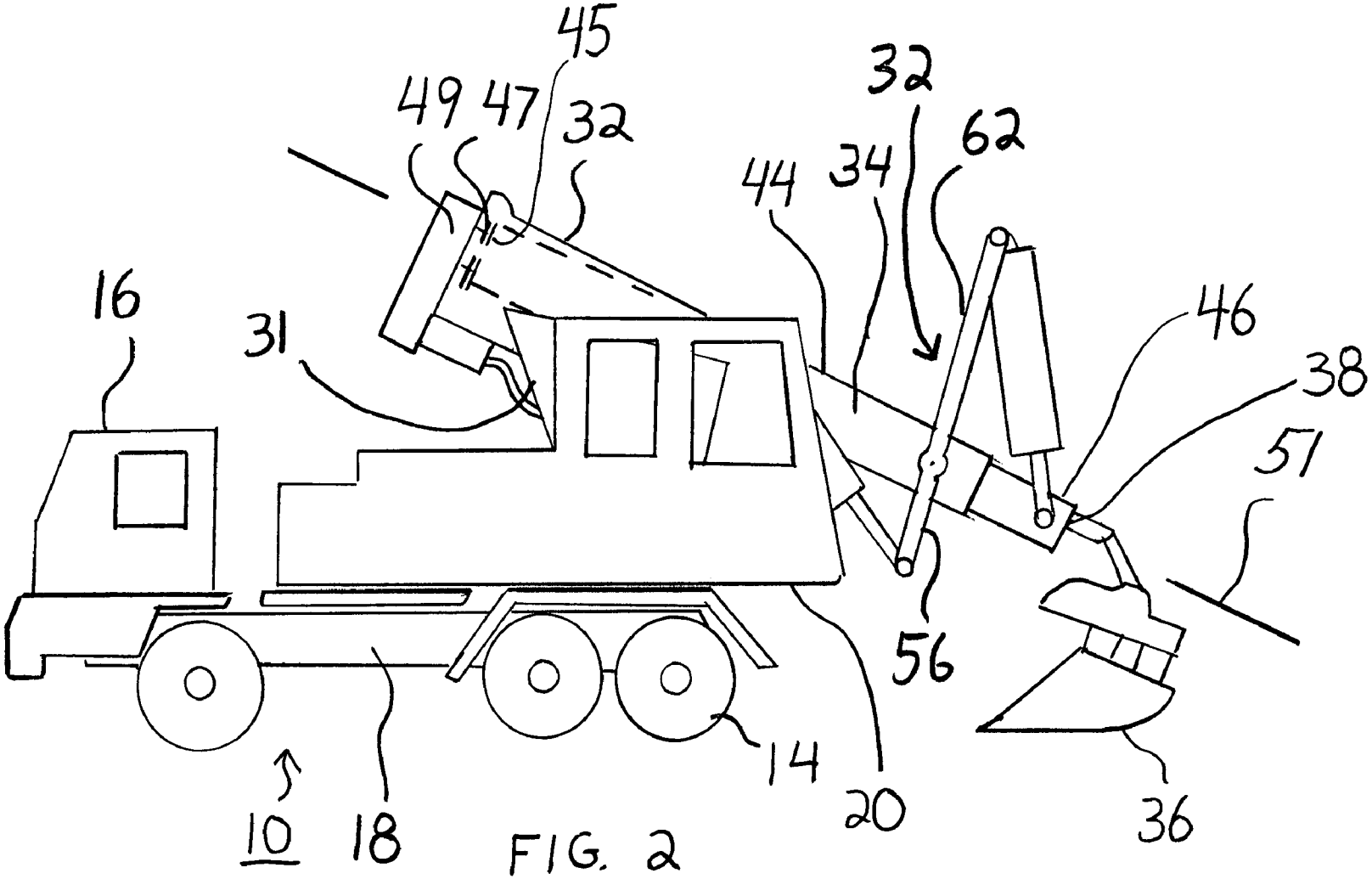
FIG. 2 is a side elevation view of an excavating apparatus in accordance with a preferred embodiment of the present invention.

The present invention will now be described in accordance with the drawings. Referring now to FIG. 2, there is shown an excavation vehicle 10 in accordance with present invention. The excavation vehicle 10 includes a set of wheel tracks 12, depicted in FIG. 3, which allow the excavation vehicle to maneuver over various types of excavation surfaces. The excavation vehicle 10 may also include wheels 14 rather than wheel tracks. The wheel tracks 12 and wheels 14 are known in the art and need not be described herein.

A vehicle driving station 16 is used to take the excavation vehicle 10 to and from a work site. The vehicle driving station 16 is connected to the vehicle mainframe 18, also referred to herein as the vehicle base 18.

Figure 5:
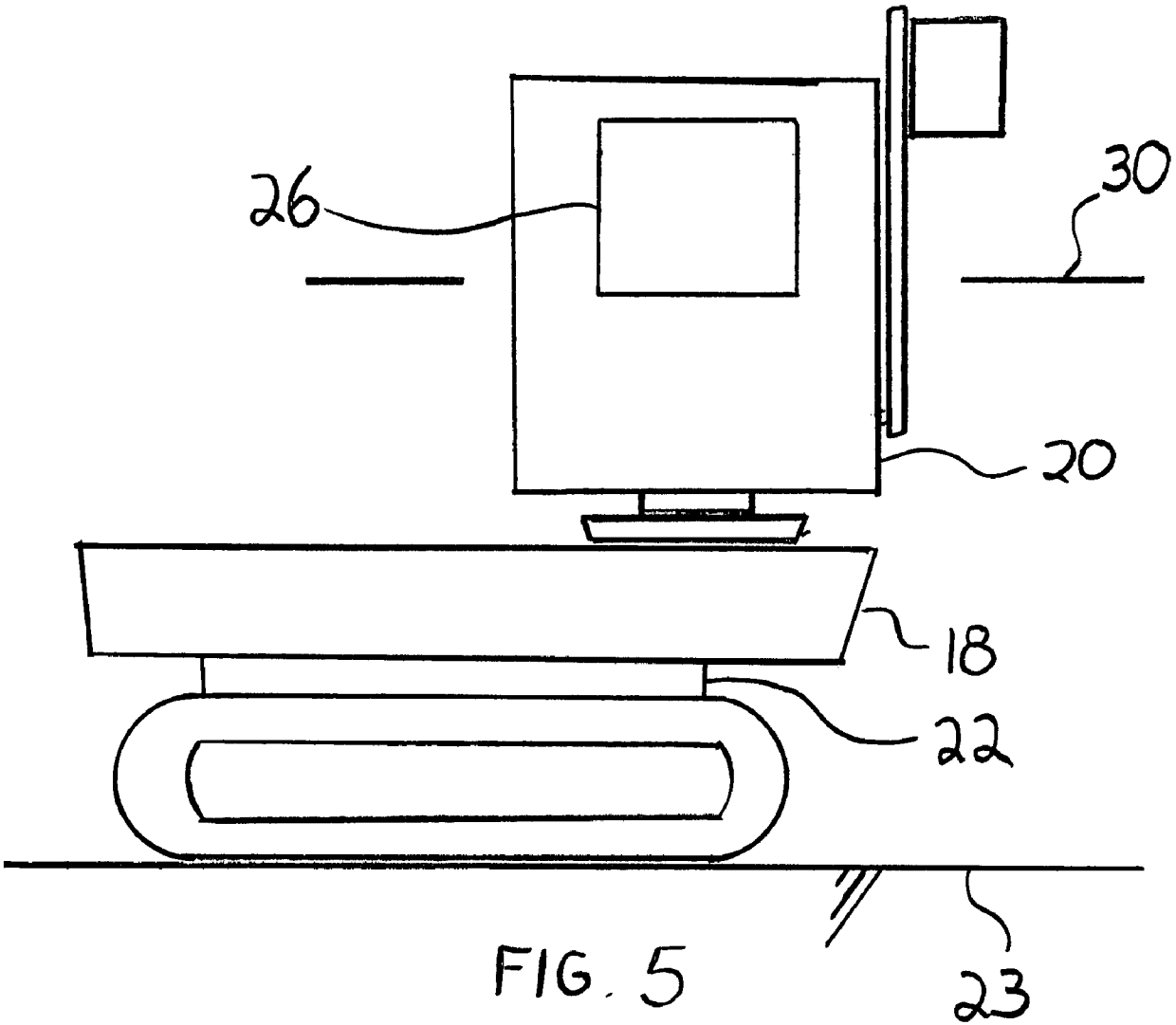
FIG. 5 is a partial side elevation view showing an operating platform rotated to ninety degrees relative to a vehicle base.

A rotating operating platform 20 rotates on a fulcrum 22, shown in FIG. 5, which is connected to the vehicle base 18. The rotating operating platform 20 includes a seating position 24 in which an operator controls all of the excavation features of the excavation vehicle 10. The operating platform 20 is typically enclosed with surrounding windows 26 which protects the operator from the elements and also allows the operator a great field of vision.

The operating platform 20 rotates in a plane parallel to the earth 23. The operating platform 20 is well known in the art and need not be described further herein. The operating platform 20 includes a longitudinal axis 28 and a latitudinal axis 30.

Figure 4:
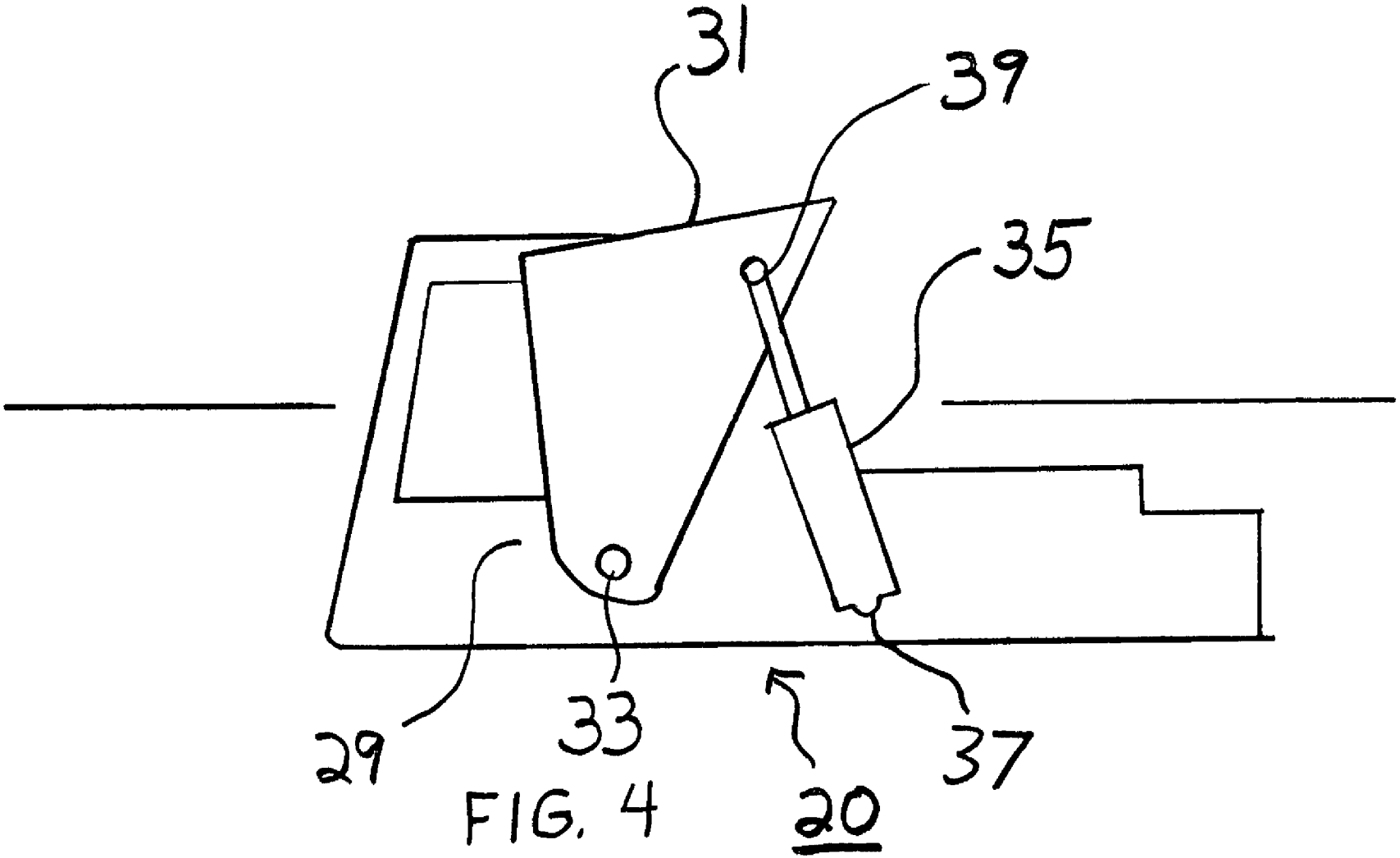
FIG. 4 is a partial side elevation view depicting a pivot plate in accordance with the present invention.

Turning now to FIG. 4, a pivot plate 31 is pivoted to one side 29 of the operating platform 20 and pivots about a pivot point 33. A pivot plate hydraulic cylinder 35 is coupled at a cylinder end 37 to the one side 29 of the operating platform 20. The pivot plate hydraulic cylinder 35 is connected at a piston end 39 to the pivot plate 31. Thus, the pivot plate hydraulic cylinder 35 rotates the pivot plate 31 about the pivot point 33, as is known in the art.

Turning back to FIG. 2, a boom support member 32 mounted to the pivot plate 31 interconnects a telescoping boom 34 to the pivot plate 31. Thus, as the pivot plate 31 rotates, the telescoping boom 34 angularly adjust with respect to the planar surface of the earth.

The telescoping boom 34 includes a fixed boom 44 having a proximate end 45. The proximate end 45 is fixedly attached to a rotating plate 47 disposed within the boom support member 32.

A worm gear 49, shown as a box in FIG. 2, rotates the rotating plate 47, by means known in the art, thus rotating the fixed boom 44 about its longitudinal axis 51. An outer boom 46 coaxially aligned with the fixed boom 44, extends from and retracts within the fixed boom 44 to adjust the length of the telescoping boom 34.

A grading bucket 36 is disposed at a boom outer end 38. Other types of operating instrument may be disposed at the boom outer end 38 in stead of the grading bucket 36. But for purposes of describing the present invention, only the grading bucket 36 shall be shown and described herein.

The operator controls the grading bucket 36 through known hydraulic pressure controlled devices to perform grading, loading and unloading. The grading bucket 36 is known as well in the art and need not be described further herein.

When the operator rotates the rotating plate 47, both the fixed boom 44, the outer boom 46 and the grading bucket rotate as well, thus adjusting the angle of the grading bucket 36 relative to the angle of the grading or digging surface (not shown). Thus, fine grading or fine angling is accomplished.

Turning now to the description of the telescoping boom 34 of the present invention, there is the fixed boom 44 which is interconnected to the pivot plate 31 through the boom support member 32.

Figure 3:
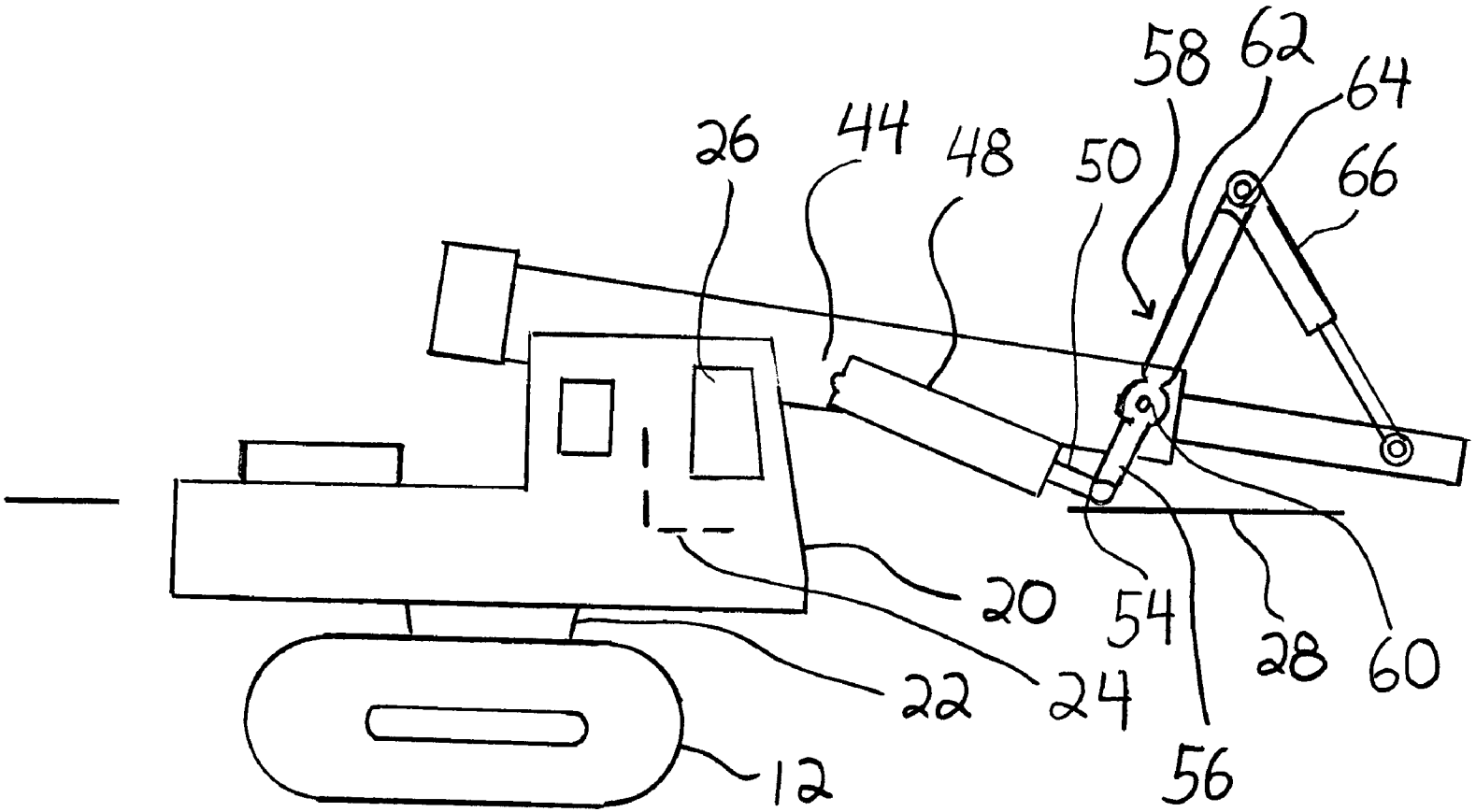
FIG. 3 is a partial side elevation view of an alternative excavating apparatus in accordance with a preferred embodiment of the present invention depicting a first hydraulic cylinder coupled between a fixed boom and a pivot segment.

A first hydraulic cylinder 48, shown in FIG. 3, is pivoted to the inner boom 44, the boom support member 32, the pivot plate 31 or to the one side 29 of the operating platform 20, which are depicted in FIG. 4. A piston 50 disposed within the first hydraulic cylinder 48 is connected at its distal end 54 to a pivot segment 56 of a linkage member 58.

The linkage member 58 is pivoted to an outer surface of the fixed boom 44 at a linkage member pivot 60. It is apparent to one skilled in the art that different types of hardware and different types of shapes and designs of the linkage member pivot 60 are suitable to accomplish the goal of pivoting the linkage member 58 to the fixed boom 44.

A lever segment 62 of the linkage member 58 extends from the pivot 60 and is pivotably connected at its distal end 64 to a second hydraulic cylinder 66. The linkage member 58 translates the inertial force created by the movement of the first hydraulic cylinder 48 across its length to the lever segment 62.

Inertial force is measured by radius and speed. The angular speed at which the pivot segment 56 and lever segment 62 move is always equal about the pivot 60. However, the pivot segment 56 moves arcuately in a motion defined by the length of the pivot segment 56, which would be its radius of motion. The lever segment 62 moves arcuately in a motion defined by the length of the lever segment 62, which would be its radius of motion. Thus, a small inertial force to the pivot segment 56 results in a larger inertial force to the lever segment 62 or, in other words, a small range of motion to the pivot segment 56 creates a larger range of motion to the lever segment 62. It is desirable that the pivot segment 56 be much smaller than the lever segment 62.

Therefore, the outer boom 46 moves quickly in response to small displacements by the piston 52 in the first hydraulic cylinder 48. The speed at which the outer boom 46 moves in and out, or extends and retracts, is a function of the proportion in length of the pivot segment 56 and the lever segment 62 of the linkage member 58.

Figure 7:
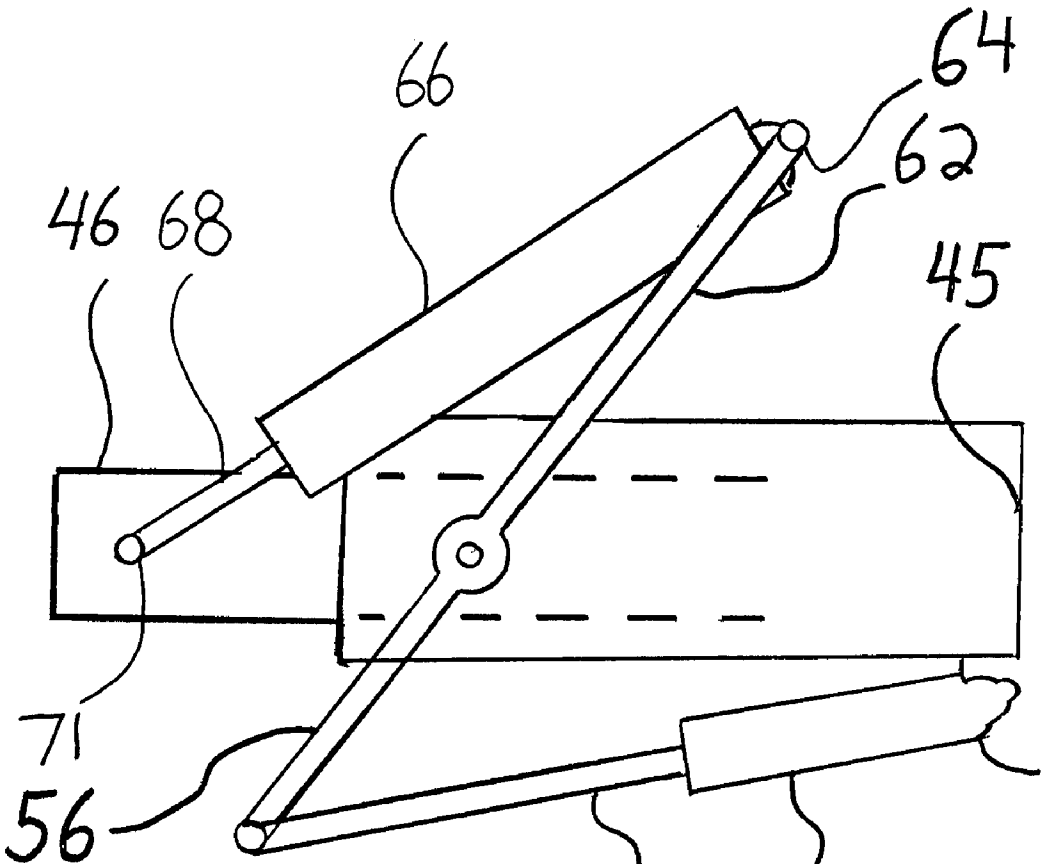
FIG. 7 is a partial side elevation view of the telescoping boom of FIG. 6, wherein the outer boom is a retracted position.

When the piston 52 of the first hydraulic cylinder 48 extends outward, depicted in FIG. 7, the distal end 64 of the lever segment 62 is rotated toward the proximate end 45 of the fixed boom 44 thus retracting the outer boom 46.

Figure 6:
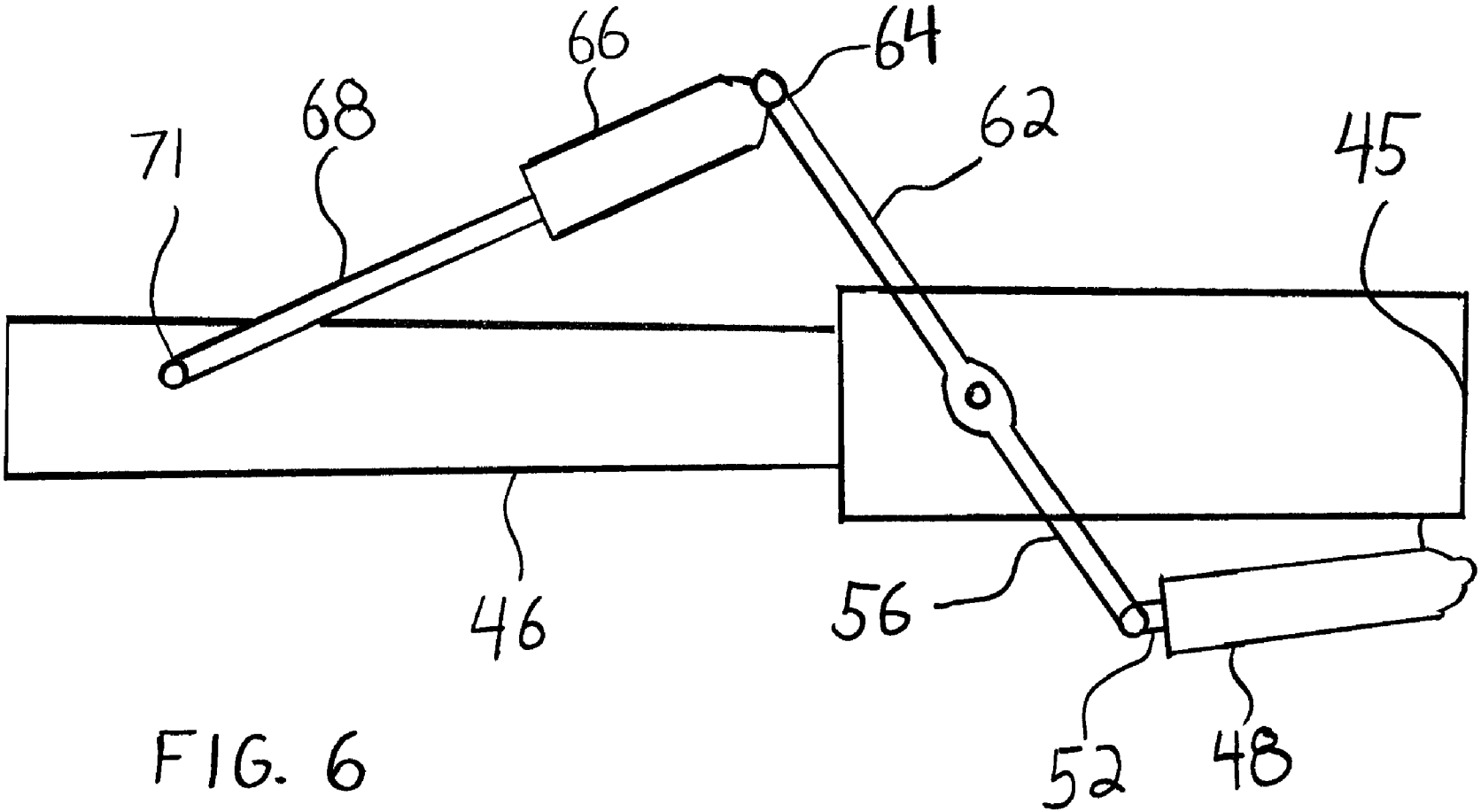
FIG. 6 is a partial side elevation view showing a fixed boom, an outer boom and the linkage member wherein the outer boom is in an extended position.

When the piston 52 of the first hydraulic cylinder 48 retracts inward, depicted in FIG. 6, the distal end 64 of the lever segment 62 is rotated away from the proximate end 45 of the fixed boom 44 thus extending the outer boom 46.

A piston 68 of the second hydraulic cylinder 66 is connected to the outer boom 46. Again, the manner of connection between the piston 68 and the outer boom 46 is readily apparent to one skilled in the art in which different types of piston connections and hardware are suitable to establish such a connection and no further description is necessary for an understanding of the invention herein.

A distal end 71 of the piston is connected to the outer boom 46.

When the piston 68 of the second hydraulic cylinder 66 retracts inward, depicted in FIG. 7, the outer boom 46 also retracts. When the piston 68 of the second hydraulic cylinder 66 extends outward, depicted in FIG. 6, the outer boom 46 also extends from the fixed boom 44.

The main advantage of using two separate hydraulic cylinders to control the movement of the outer boom 46 is that the speed at which the outer boom moves in and out is dramatically increased through the linkage member 58 as described herein. It is not necessary to displace enough hydraulic fluid to move a long slow moving piston stroke to effectuate the movement of the outer boom 46. Rather, the movement of the outer boom is now accomplished through short quick strokes of two shorter hydraulic cylinders utilizing the linkage member 32.

Figure 8:
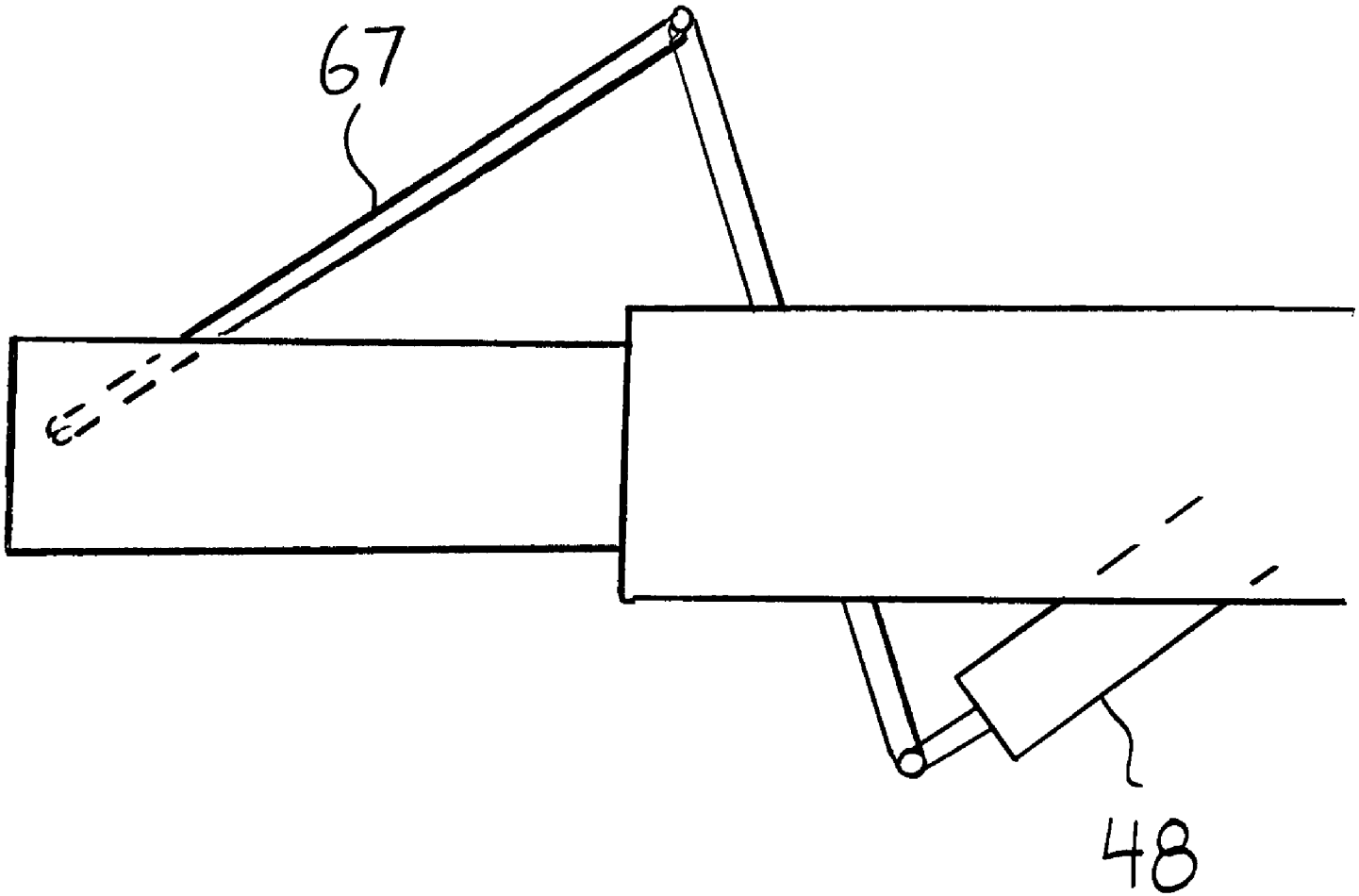
FIG. 8 is a partial side elevation view of the telescoping boom of FIG. 6, in which a fixed length linkage couples a lever segment of a linkage member to the outer boom.

Turning to FIG. 8, the second hydraulic cylinder 66 is replaced by a fixed length linkage 67. In this embodiment, only the first hydraulic cylinder 48 controls the extension and retraction of the outer boom 46.

Figure 9:
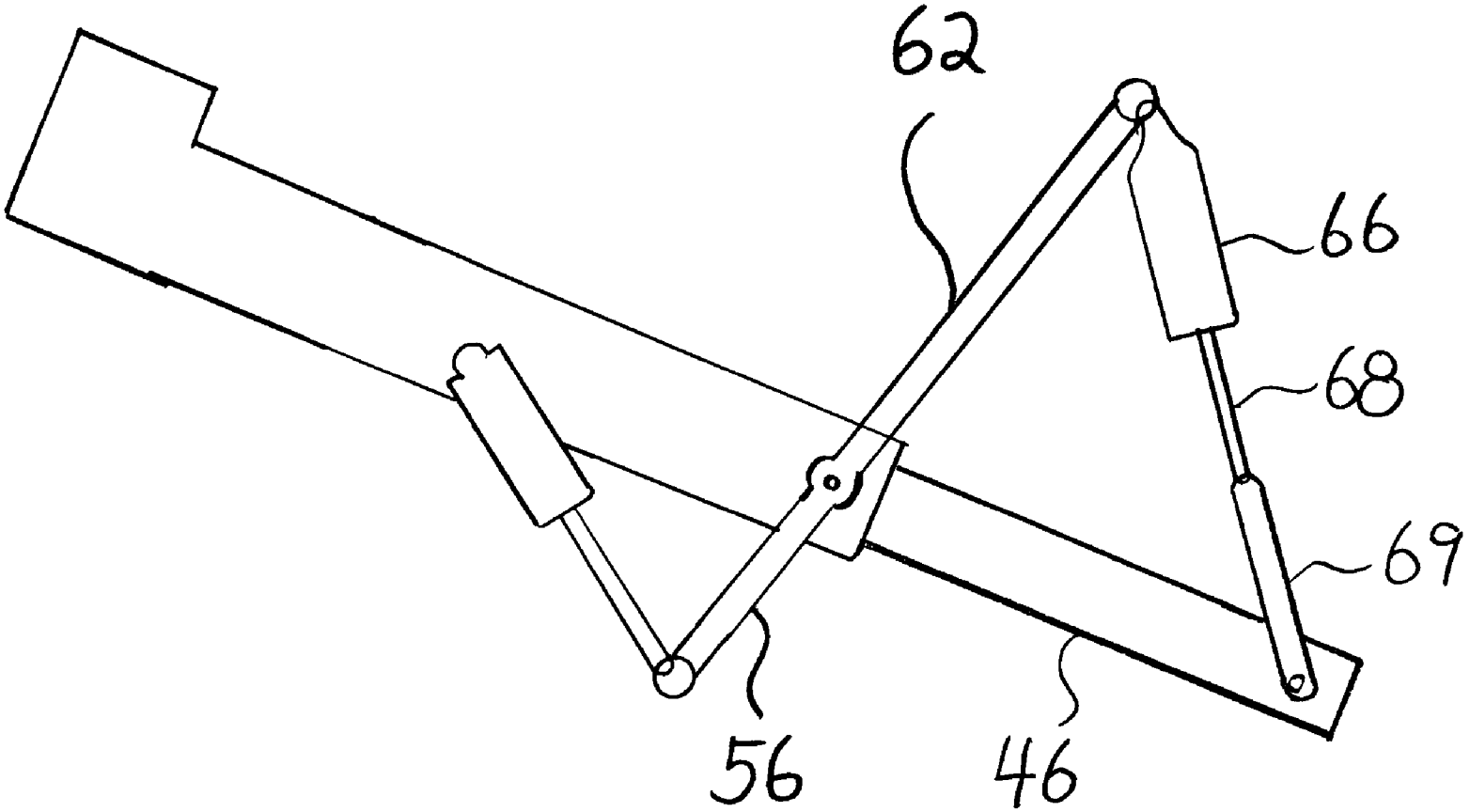
FIG. 9 is a partial side elevation view of the telescoping boom of FIG. 6, in which a hydraulic cylinder having an intermediate linkage member disposed at one end couples a lever segment of a linkage member to the outer boom.
Figure 10:
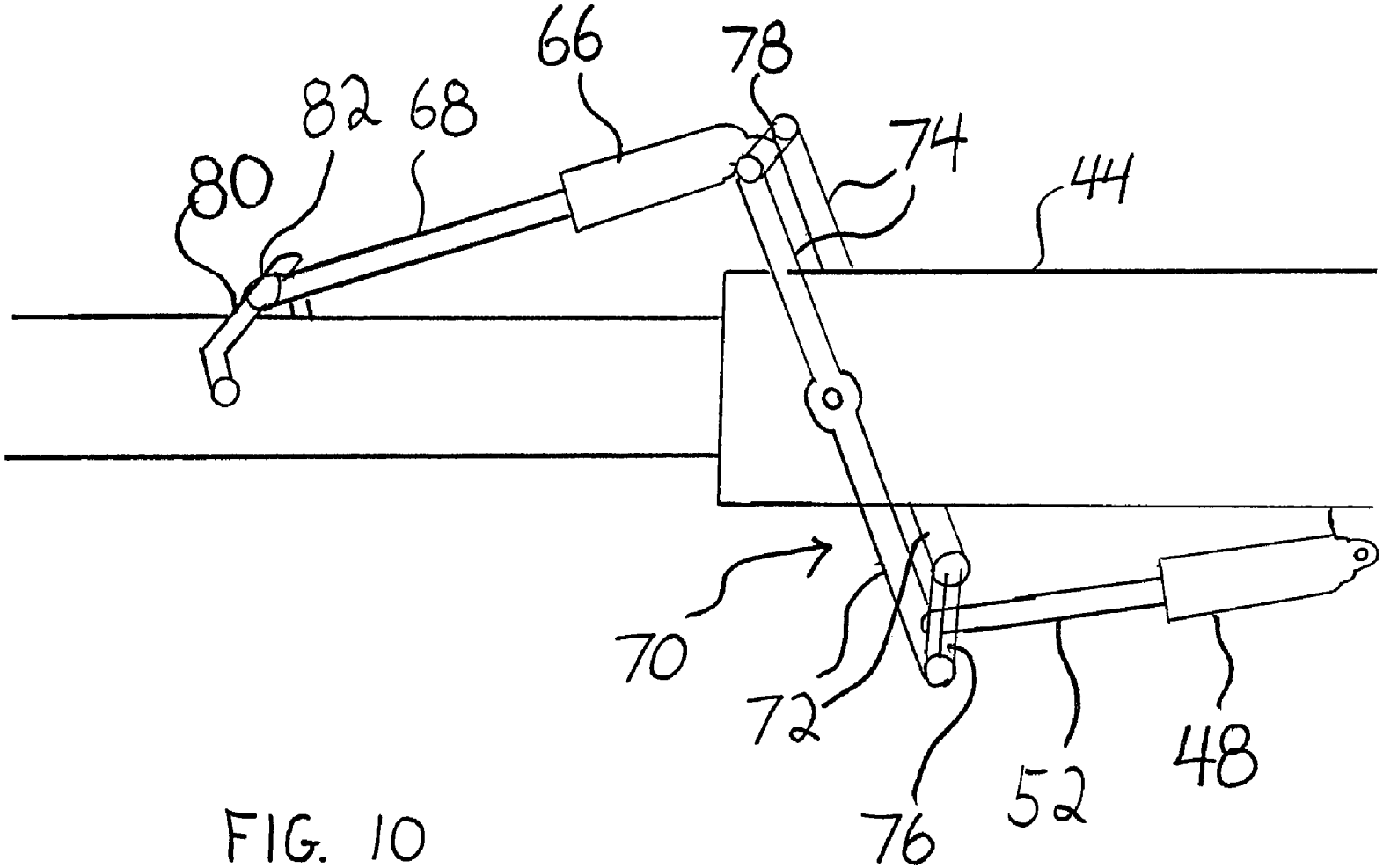
FIG. 10 is a partial side elevation view an alternative embodiment of the linkage member of the present invention.

Turning to FIG. 9, the length of the piston 68 of the second hydraulic cylinder 66 is extended or adjusted simply by interconnecting an intermediate linkage member 69 between the distal end 71 of the piston 68 and the outer boom 46.

In an alternate embodiment of the present invention, a dual linkage member 70 includes parallel situate pivot segments 72 and parallel situate lever segments 74 that are interconnected via a pivot cross arm 76 and a lever segment cross arm 78, respectively. The dual linkage member 70 is thus pivoted to two sides of the fixed boom 44. The piston 52 of the first hydraulic cylinder 48 is connected to the pivot cross arm 76. The second hydraulic cylinder 66 is pivoted to the lever segment cross arm 78.

A u-shaped connector 80 is interconnected to the outer boom 46. Again, to one skilled in the art the u-shaped connector 80 can take on many varying sizes, shapes and forms. For instance, an eye-bolt (not shown) can be used to provide the same effect as a u-shaped connector 80. The piston 68 of the second hydraulic cylinder 66 is connected to a u-shaped coupler 82.

Where a larger load of earth is being operated on by the grading bucket it is often times necessary to increase power to the outer boom 46. The power of the outer boom 46 is increased by using a two cylinders from the fixed boom 44 to the linkage member 32 or the dual linkage member 70.

Figure 11:
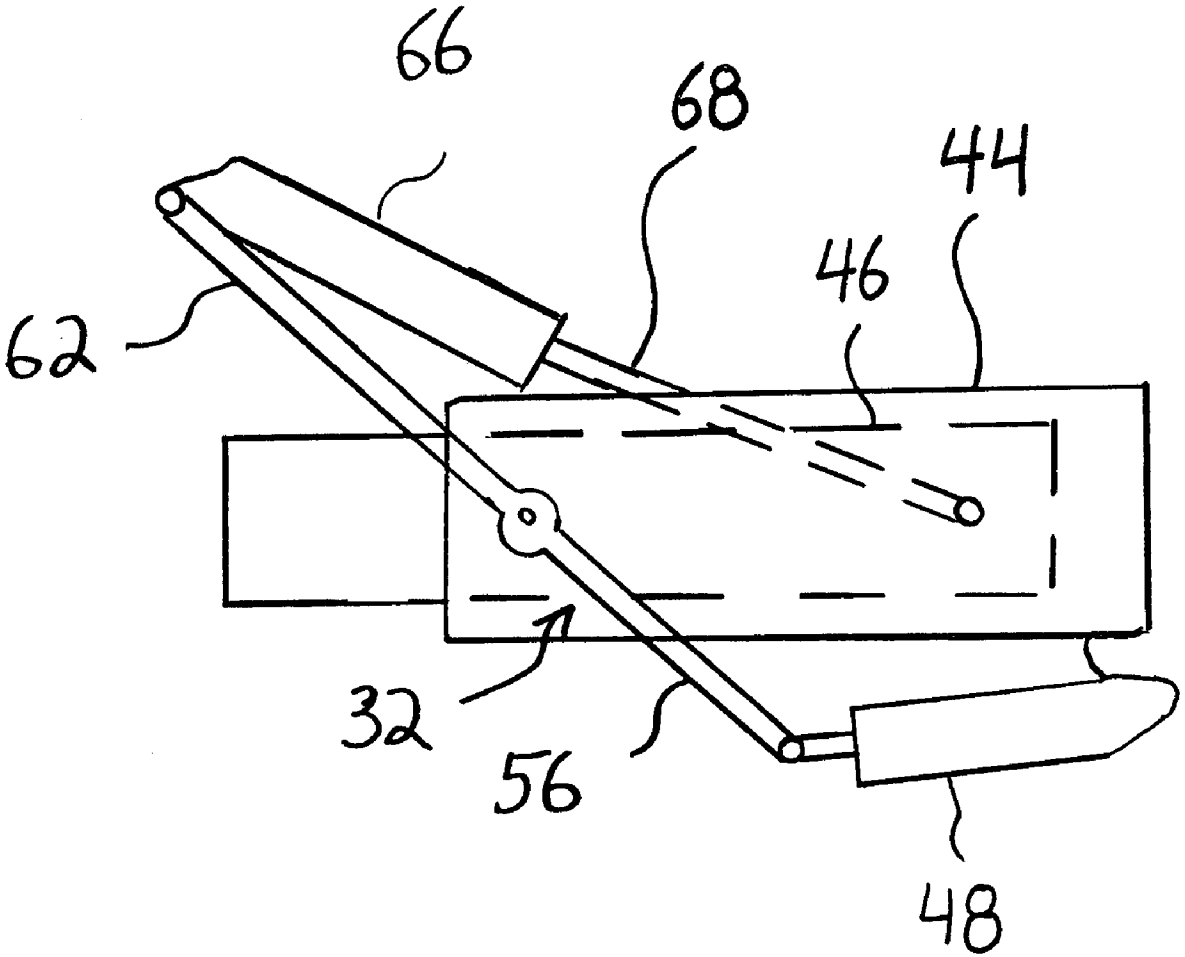
FIG. 11 is a partial side elevation view of the telescoping boom of FIG. 6, in which a second displacement member couples a lever segment to the outer boom in which the extending member of the second displacement member is directed away from the distal end of the outer boom.
Figure 12:
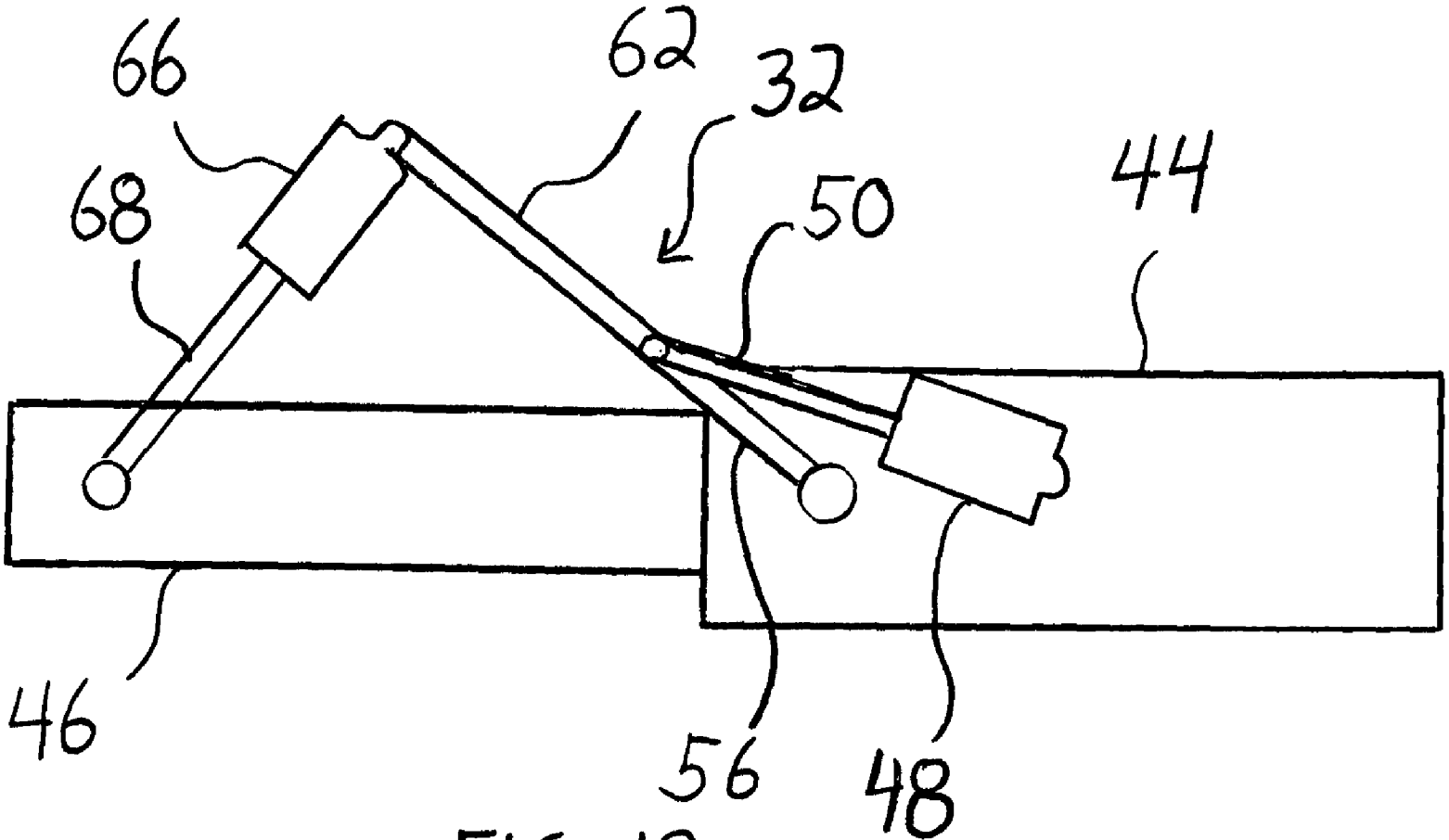
FIG. 12 is a partial side elevation view of the telescoping boom of FIG. 6, in which the linkage member extends from the pivot point in only one direction.

Other embodiments of placement of the first and second hydraulic cylinders are depicted in FIGS. 11 and 12. Turning to FIG. 12, the second hydraulic cylinder 66 actually is disposed in an opposite direction from the embodiments previously described.

In FIG. 12, the placement of the first hydraulic cylinder 48 actually redefines the pivot segment 56 and the lever segment 62 of the linkage member 32.

Various changes and modifications, other than those described above in the preferred embodiment of the invention described herein will be apparent to those skilled in the art. While the invention has been described with respect to certain preferred embodiments and exemplifications, it is not intended to limit the scope of the invention thereby, but solely by the claims appended hereto.

What is claimed is:

1. An excavating apparatus for excavating a surface, said apparatus comprising:

a vehicle base having at least one wheel means integrated with the vehicle base and at least one operating platform having a longitudinal and a latitudinal axis;

a boom support member disposed adjacent to said operating platform;

a telescoping boom supported by said boom support member, said telescoping boom including a fixed boom, said fixed boom having a longitudinal axis, said telescoping boom further including an outer boom which retracts and extends within said fixed boom, said outer boom also having a longitudinal axis which is coaxial to the longitudinal axis of said fixed boom;

a first rotation means for rotating said fixed boom radially about its longitudinal axis;

a second rotation means for rotating said telescoping boom radially about the latitudinal axis of said at least one operating platform;

at least one first displacement member coupled at a first end to a member selected from the group consisting essentially of the boom support member, fixed boom, a pivot plate and the operating platform, said at least one first displacement member including a housing and a retractable extension member;

a linkage member pivoted to said fixed boom at a fixed pivot, said linkage member including at least one pivot segment, wherein said at least one pivot segment includes a distal end and a pivot end, wherein said distal end of said pivot segment is directly connected and pivoted to said retractable extension member of said at least one first displacement member, and wherein said pivot end is fixed in space with respect to the fixed boom, said linkage member further including at least one lever segment;

coupling means for coupling said at least one lever segment to said outer boom;

an operating implement connected to a distal end of said outer boom; and control means for controlling the operating platform, the at least one first displacement member, the operating implement, the first rotating means and the second rotating means.

2. The excavating apparatus of claim 1, wherein said coupling means further includes at least one second displacement member having a housing and a retractable extension member, said housing of said at least one second displacement member being coupled to the lever segment of said linkage member, and wherein said coupling means further includes an extension member coupling means for coupling said retractable extension member of said at least one second displacement member to said outer boom, wherein said control means further includes means for controlling the at least one second displacement member.

3. The excavating apparatus of claim 1, wherein said at least one first displacement member includes a device selected from a hydraulic cylinder and a pneumatic cylinder.

4. The excavating apparatus of claim 2, wherein said at least one second displacement member includes a device selected from a hydraulic cylinder and a pneumatic cylinder.

5. The excavating apparatus of claim 2, wherein said extension member coupling means further includes a pair of opposing upright members attached to opposing outer surfaces of said outer boom, said upright members being interconnected by a cross bar section, and wherein said retractable extension member of said at least one second displacement member includes a distal end coupled to said cross bar section.

6. The excavating apparatus of claim 2, wherein said linkage member includes a pair of parallel situate linking members, each of said linking members pivoted to opposing outer surfaces of said fixed boom, each of said parallel situate linking members including a pivot segment and a lever segment, wherein each of said pivot segments is conjoined by a first crossarm, and wherein said retractable extension member is pivoted to said first crossarm.

7. The excavating apparatus of claim 6, wherein each of said lever arms is conjoined by a second crossarm, and wherein said housing member said at least one second displacement member is coupled to said second crossarm.

8. A telescoping boom system for a excavating apparatus, wherein said excavating apparatus includes a construction vehicle having at least one wheel means integrated with a vehicle base and at least one operating platform, said at least one operating platform including a longitudinal and latitudinal axis, said telescoping boom system comprising;

a boom support member disposed adjacent to said at least one operating platform;

a telescoping boom supported by said boom support member, said telescoping boom including a fixed boom, said fixed boom having a longitudinal axis, said telescoping boom further including an outer boom which retracts and extends within said fixed boom, said outer boom also having a longitudinal axis which is coaxial to the longitudinal axis of said fixed boom;

a first rotation means for rotating said fixed boom radially about its longitudinal axis;

a second rotation means for rotating said telescoping boom radially about the latitudinal axis of said at least one operating platform;

at least one first displacement member coupled at a first end to a member selected from the group consisting essentially of the boom support member, fixed boom, a pivot plate and the operating platform, said at least one first displacement member including a housing and a retractable extension member;

a linkage member pivoted to said fixed boom at a pivot, said linkage member including at least one pivot segment, wherein said at least one pivot segment includes a distal end and a pivot end, wherein said distal end of said pivot segment is directly connected and pivoted to said retractable extension member of said at least one first displacement member, and wherein said pivot end is fixed in space with respect to the fixed boom, said linkage member further including at least one lever segment;

coupling means for coupling said at least one lever segment to said outer boom;

an operating implement connected to a distal end of said outer boom; and control means for controlling the operating platform, the at least one first displacement member, the operating implement, the first rotating means and the second rotating means.

9. The telescoping boom system of claim 8, wherein said coupling means further includes at least one second displacement member having a housing and a retractable extension member, said housing of said at least one second displacement member being coupled to said at least one lever segment of said linkage member, and wherein said coupling means further includes an extension member coupling means for coupling said retractable extension member of said at least one second displacement member to said outer boom, wherein said control means further includes means for controlling the at least one second displacement member.

10. The telescoping boom system of claim 8, wherein said at least one first displacement member includes a device selected from a hydraulic cylinder and a pneumatic cylinder.

11. The telescoping boom system of claim 9, wherein said at least one second displacement member includes a device selected from a hydraulic cylinder and a pneumatic cylinder.

12. The telescoping boom system of claim 9, wherein said extension member coupling means further includes a pair of opposing upright members attached to opposing outer surfaces of said outer boom, said upright members being interconnected by a cross bar section, and wherein said retractable extension member of said at least one second displacement member includes a distal end coupled to said cross bar section.

13. The telescoping boom system of claim 9, wherein said linkage member includes a pair of parallel situate linking members, each of said linking members pivoted to opposing outer surfaces of said fixed boom, each of said parallel situate linking members including a pivot segment and a lever segment, wherein each of said pivot segments is conjoined by a first crossarm, and wherein said retractable extension member is pivoted to said first crossarm.

14. The telescoping boom system of claim 13, wherein each of said lever segments is conjoined by a second crossarm, and wherein said housing member said at least one second displacement member is coupled to said second crossarm.

* * * * *